US007518564B2

(12) United States Patent
Guthrie

(10) Patent No.: US 7,518,564 B2
(45) Date of Patent: Apr. 14, 2009

(54) SLOT ANTENNA

(75) Inventor: Warren E. Guthrie, West Olive, MI (US)

(73) Assignee: Twisthink, L.L.C., Holland, MI (US)

( * ) Notice: Subject to any disclaimer, the term of this patent is extended or adjusted under 35 U.S.C. 154(b) by 93 days.

(21) Appl. No.: 11/752,553

(22) Filed: May 23, 2007

(65) Prior Publication Data

US 2008/0001836 A1 Jan. 3, 2008

Related U.S. Application Data

(60) Provisional application No. 60/803,042, filed on May 24, 2006.

(51) Int. Cl.
*H01Q 13/10* (2006.01)

(52) U.S. Cl. ..... 343/767

(58) Field of Classification Search ..... 343/767, 343/770, 700 MS

See application file for complete search history.

(56) References Cited

U.S. PATENT DOCUMENTS 5,489,913 A 2/1996 Raguenet et al.
5,677,698 A 10/1997 Snowdon
5,754,143 A * 5/1998 Warnagiris et al. ..... 343/767
6,188,368 B1 2/2001 Koriyama et al.
6,636,183 B1 * 10/2003 Hellgren et al. ..... 343/767
6,664,931 B1 12/2003 Nguyen et al.
6,791,467 B1 9/2004 Ben-Ze'ev
6,864,848 B2 * 3/2005 Sievenpiper ..... 343/767
6,891,510 B2 5/2005 Le Bolzer et al.
6,963,312 B2 * 11/2005 Schuneman et al. ..... 343/767
6,999,037 B2 2/2006 Apostolos
6,999,038 B2 2/2006 Louzir et al.
7,002,519 B2 2/2006 Wang et al.
7,053,848 B2 * 5/2006 Shoji et al. ..... 343/770
2005/0231434 A1 10/2005 Azadegan et al.

OTHER PUBLICATIONS

Kamal Sarabandi and Reza Azadegan, "Design of an Efficient Miniaturized UHF Planar Antenna", IEEE Transactions on Antennas and Propagation, vol. 51, No. 6, Jun. 2003.

* cited by examiner

*Primary Examiner*—Hoang V Nguyen
(74) *Attorney, Agent, or Firm*—Warner Norcross & Judd LLP

(57) ABSTRACT

The specification discloses a slot antenna in which the slot opens through an edge of the conductor. Preferably, the slot is nonlinear (e.g. a zigzag shape) enabling a compact configuration in which a relatively long slot is configured in a relatively small conductor.

12 Claims, 3 Drawing Sheets

SLOT ANTENNA

This application claims priority from provisional U.S. Application No. 60/803,042 filed May 24, 2006 and entitled "Improved Slot Antenna."

BACKGROUND OF THE INVENTION

The present invention relates to antennas and more particularly to slot antennas.

A slot antenna an electrically conductive sheet or plate (e.g. aluminum, copper, or other conductive metal or alloy) that defines a slot where the conductor is missing. When the plate is driven as an antenna by a driving frequency, the slot radiates electromagnetic waves like a dipole antenna.

FIG. 1 shows a typical prior art slot antenna 10. The length of the slot 12 determines the optimum operating frequency of the slot antenna 10. The length of the slot 12 is approximately one-half of the wavelength of the optimum operating frequency. Each end of the slot has no electric field because the conductive material will not support a voltage potential. The center of the slot supports a high electric field. The variation of the electric field along the length of the slot has a corresponding impedance variation. The center of the slot supports a high voltage field (E-field) and a low magnetic field (B-field), so the impedance is high. Each end of the slot has a low E-field and a high B-field, so the impedance is low. A relatively narrow slot tends to decrease the capacitive reactance of the slot antenna 10, and a relatively wide slot tends to increase the capacitive reactance of the antenna.

Exciting the slot antenna is accomplished by establishing an alternating current (AC) voltage potential across the slot. The most efficient means of excitation is a power source with an impedance that is matched to the location of the feed. So, feeding across the center of the slot would require a high-impedance source, and feeding across other locations along the length of the slot would require lower-impedance sources. Typically, the feed point is located near one end of the slot so that the impedance is near the standard value of 50 ohms.

The AC voltage is applied across the slot 12 by way of the feed 14. By adjusting the location of the feed 14 along the length of the slot 12, the impedance of the antenna 10 can be matched to the impedance of the power source. The reactance of the slot may be matched to the reactance of the power source by varying the slot width.

While slot antennas have proven to be effective in many applications, the size required of a slot antenna limits the variety of applications in which such an antenna can be used, especially in view of the constant size reduction of products. Therefore, a slot antenna of reduced size is highly desirable.

SUMMARY OF THE INVENTION

The present invention is a slot antenna in which the slot opens through an edge of the antenna. Because the length of the open slot need only be one-quarter of the design wavelength, rather than the one-half of the design wavelength as in the prior art, the antenna of the present invention is significantly smaller than a corresponding prior art antenna.

Preferably, the slot is nonlinear, enabling the antenna to be further reduced in size. For example, the slot could be zigzag shaped. Or as another example, the slot could have a T shaped closed end. A nonlinear slot enables a slot to be more compactly placed on the antenna in an area having dimensions less than the quarter-wavelength.

These and other objects, advantages, and features of the invention will be more fully understood and appreciated by reference to the descriptions of the current embodiments.

DESCRIPTIONS OF THE CURRENT EMBODIMENTS

I. First Embodiment

Figure 1:
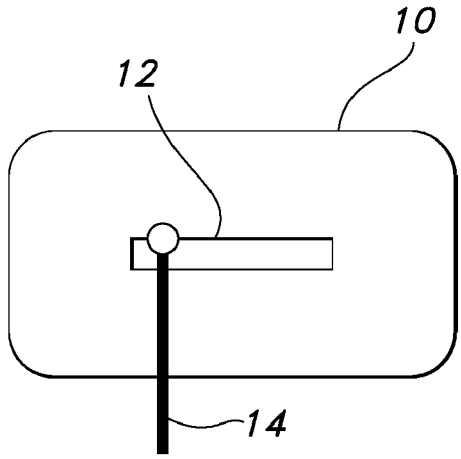
FIG. 1 (Prior Art)
FIG. 1 is a plan view of a prior art slot antenna.
Figure 2:
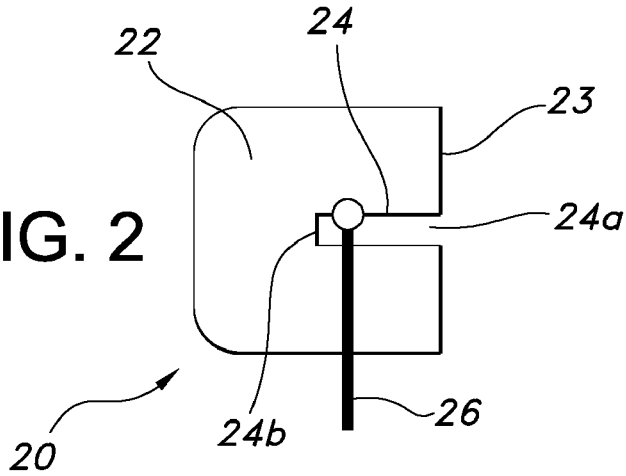
FIG. 2 is a plan view of a first embodiment of the slot antenna of the present invention.

A slot antenna constructed in accordance with a first embodiment of the invention is shown in FIG. 2 and generally designated 20. The antenna includes a conductor 22 having an edge 23. The slot 24 opens through the edge 23 of the conductor 22. The slot includes an open end 24*a* adjacent the edge and an opposite closed end 24*b*. The length of the slot 24 is approximately one-quarter (¼) of the wavelength of the optimum operating frequency or the design frequency of the antenna 20.

The high-impedance point of the antenna 20 is the open end 24*a* of the slot 24. This point approximates the impedance of the center of the closed slot antenna of the prior art. Consequently, the slot 24 may be approximately one-half as long a closed slot, resulting in an antenna that is approximately one-half the area of a closed slot antenna.

II. Second Embodiment

Figure 3:
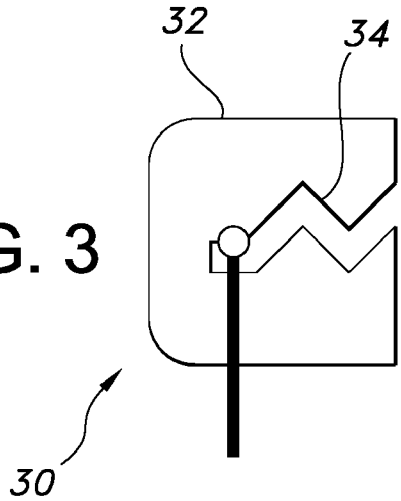
FIG. 3 is a plan view of a second embodiment of the slot antenna.

A second embodiment of the slot antenna is shown in FIG. 3 and generally designated 30. In this embodiment, the slot 34 is nonlinear and specifically is zigzag shaped (i.e. a series of short sharp turns, angles, or alterations in course). The slot 34 includes several different connected slot segments, with each segment being at an angle with respect to any adjacent segments. Other nonlinear configurations for the slot 34 are within the scope of the present invention and include, for example, curves, segmented curves, or combinations of linear and nonlinear segments.

III. Third Embodiment

Figure 4:
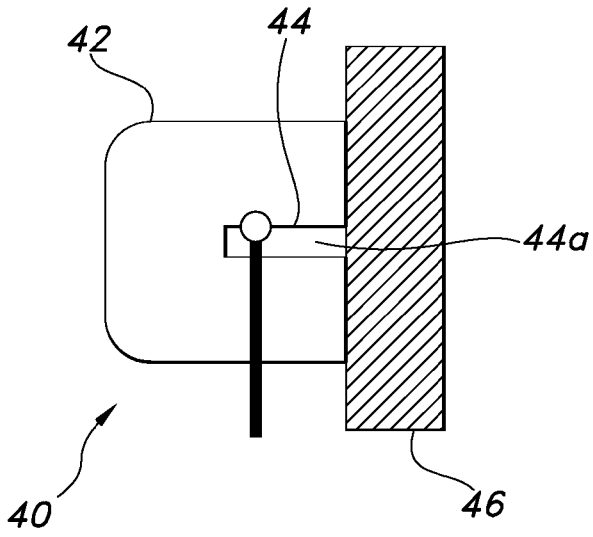
FIG. 4 is a plan view of a third embodiment of the slot antenna.

A third embodiment of the slot antenna is shown in FIG. 4 and generally designated 40. The slot 44 is shown as linear, although other configuration such as those discussed elsewhere in this application could be used. A dielectric material 46 is positioned at the edge of plate 42 adjacent the slot. With or without the dielectric 46, fringing can occur near the open end 44*a* of the slot 22. By placing the dielectric 46 adjacent the open end 44*a*, the fringing effect can be enhanced or dissipated, thereby changing the characteristics of the antenna 40. The inclusion of the dielectric therefore may increase the performance of the slot antenna 40 and may allow the size of the conductor 42 to be further reduced.

IV. Fourth Embodiment

Figure 5:
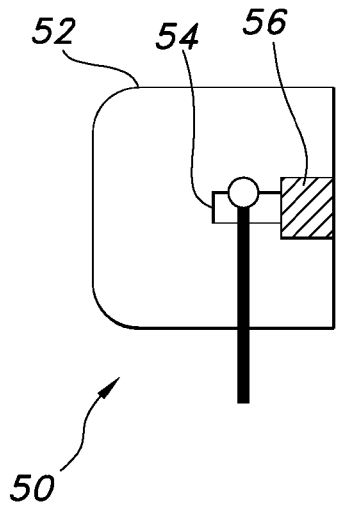
FIG. 5 is a plan view of a fourth embodiment of the slot antenna.

A fourth embodiment of the slot antenna is shown in FIG. 5 and generally designated 50. The slot 54 is shortened, thereby enabling the overall size of plate 52 to be reduced. A portion of the slot 54 adjacent to the open end and including the open end is covered with a dielectric material 56. The dielectric material could cover a larger or smaller portion of the slot 54 than the portion illustrated. The dielectric material 56 also could wrap around the edge of the plate 52 to partially envelope the plate. The inclusion of the dielectric material 56 impacts fringing and performance as discussed elsewhere in this application.

V. Fifth Embodiment

Figure 6:
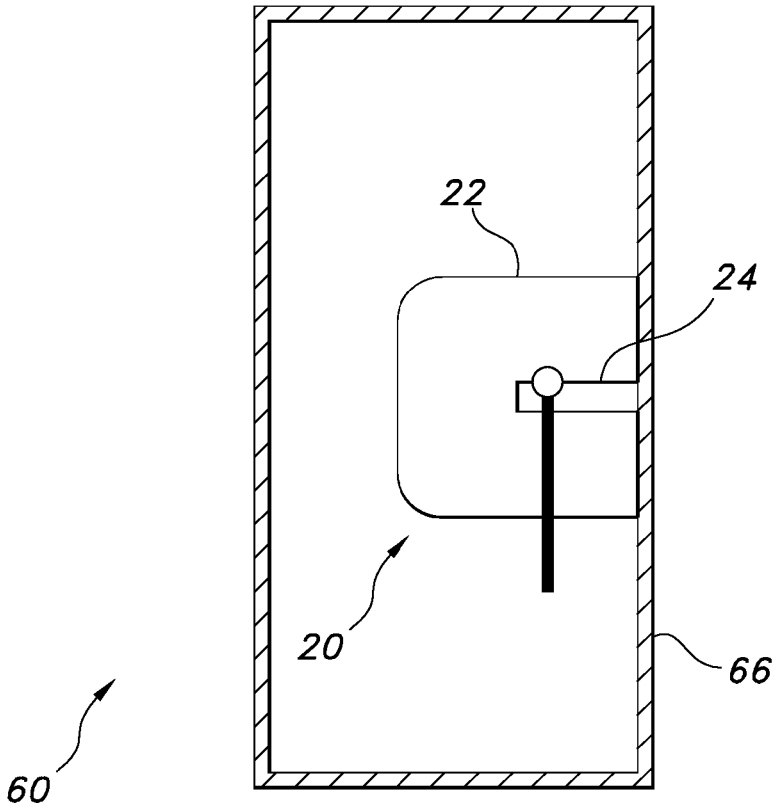
FIG. 6 is a plan view of an assembly including the first embodiment of the slot antenna.

An assembly incorporating the first embodiment 20 of the slot antenna is shown in FIG. 6 and generally designated 60. Any other of the antenna embodiments alternatively could be included in the assembly 60. The assembly includes a case or housing 66 within which the slot antenna 20 is supported. The case 66 could be for a cellular telephone, a personal digital assistant (PDA), or any other electronic device including an antenna. As currently contemplated, the case 66 is fabricated of a dielectric material to achieve or supplement the dielectric effects described elsewhere in this application, particularly when the open end of the slot 24 abuts the case 66.

VI. Sixth Embodiment

Figure 9:
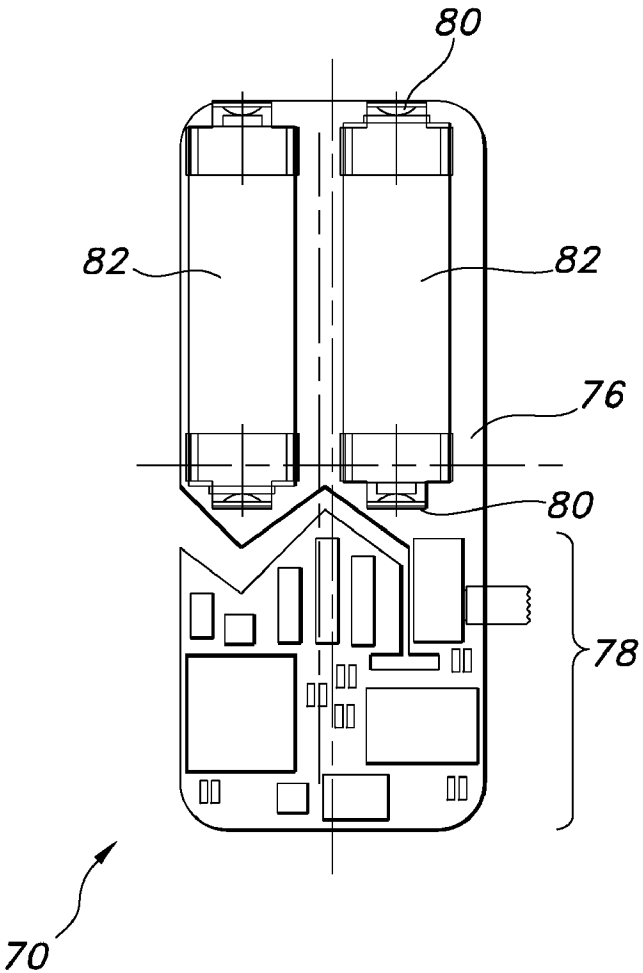
FIG. 9 is a bottom plan view of the fifth embodiment of the slot antenna.
Figure 8:
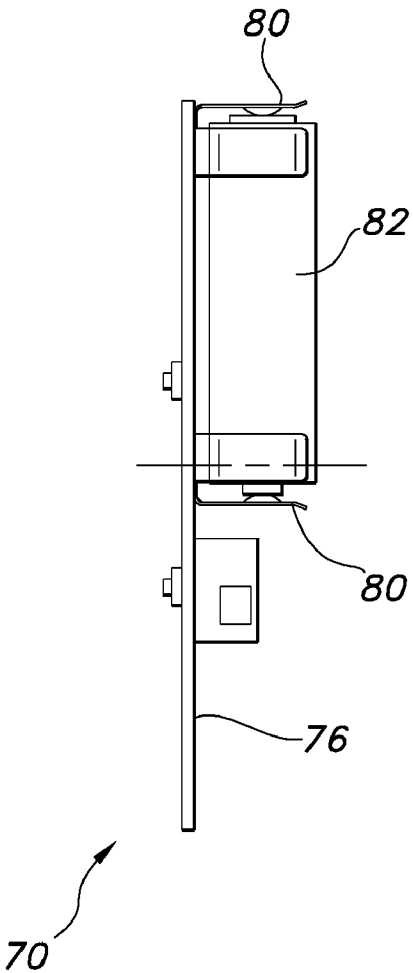
FIG. 8 is a side view of the fifth embodiment of the slot antenna.
Figure 7:
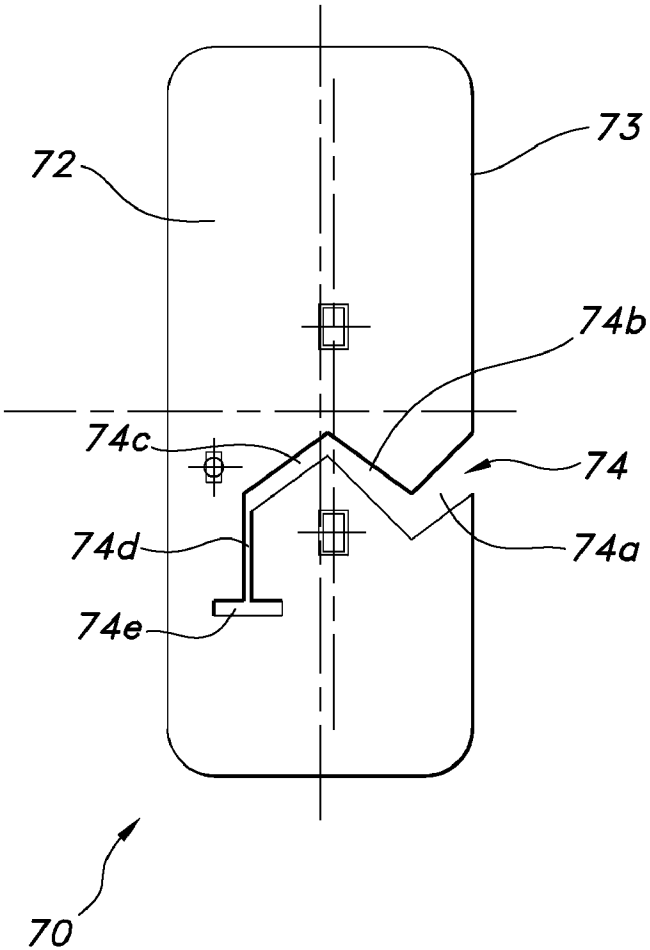
FIG. 7 is a top plan view of a fifth embodiment of the slot antenna.

A sixth embodiment of the invention is illustrated in FIGS. 7-9 and generally designated 70. The antenna includes a conductor 72 having an edge 73. A zigzag slot 74 in the conductor opens through the edge 73.

The slot 74 includes a plurality of linear segments 74*a* through 74*d* that define the zigzag shape. The width of each segment is at least as wide as the adjacent segment (if any) toward the closed end of the slot and at least as narrow as the adjacent segment (if any) toward the open end of the slot. The segments 74*a* and 74*b* each increase in width toward the open end of the slot so that they "flair open" in the direction of the open end. The increasing width from the closed end to the open end produces a higher impedance toward the open end of the slot, which further increases the effective length of the slot.

The closed end of the slot is T shaped to further effectively increase the length of the slot 74 without requiring a corresponding increase in the size of the conductor 72.

The conductor 72 is printed on one side of a circuit board 76. The other side of the board supports circuit components 78 and a battery support 80 for batteries 82. (See FIGS. 8-9) The circuit components, the battery support, and the batteries all are well known to those skilled in the art and therefore will not be described in detail. At least one of the circuit components is electrically connected to the antenna feed.

VII. Conclusion

The natural symmetry of the antennas of the present invention enables the antenna to be centered between two "plug" locations on a circuit board to provide isolation of the radiating region (i.e. the region between the two electrodes) from the top and the bottom of the receptacle.

The antennas of the present invention provide more consistent performance in the presence of objects. The antennas also can be embedded in circuit boards within a relatively small amount of space.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any reference to a claim element in the singular, for example, using the articles "a," "an," "the," or "said," is not to be construed as limiting the element to the singular.

The invention claimed is:

1. A slot antenna comprising:

a planar electrical conductor having an edge;

the conductor defining a zigzag-shaped slot opening through the edge, the slot including an open end and a closed end, the slot further including a plurality of linear segments between the open end and the closed end, a first segment defining a first width and a second segment defining a second width greater than the first width, the second segment being closer to the open end of the slot; and a feed connected across the slot.

2. A slot antenna as defined in claim 1 wherein the closed end defines a T shape.

3. A slot antenna as defined in claim 1 wherein the length of the slot is one-quarter of the design wavelength of the antenna.

4. A slot antenna as defined in claim 1 further comprising a dielectric adjacent the open end of the slot.

5. A slot antenna comprising:

an electrically conductive antenna body having an edge;

the antenna body defining a zigzag-shaped slot opening through the edge to define an open end and a closed end, the slot including a plurality of linear segments between the open end and the closed end, wherein the width of at least one linear segment is greater than the width of at least another linear segment that is closer to the closed end of the slot.

6. A slot antenna as defined in claim 5 wherein the slot has a closed end defining a T shape.

7. The slot antenna of claim 5 further comprising a feed connected across the slot.

8. A slot antenna assembly comprising:

a circuit board;

an antenna layer on the circuit board, the antenna layer having an edge, the antenna layer defining a zigzag slot opening through the edge, the zigzag slot including a plurality of linear slot segments, an open end adjacent the edge, and an opposite closed end, wherein the plurality of linear slot segments includes a first segment defining a first width and a second segment defining a second width greater than the first width, the second segment being closer to the open end of the slot than is the first segment;

a feed connected across the zigzag slot; and a plurality of circuit components supported by the board, at least one of the plurality of circuit components electrically connected to the feed.

9. A slot antenna as defined in claim 8 wherein the closed end of the slot defines a T shape.

10. A slot antenna as defined in claim 9 wherein the length of the zigzag slot is one-quarter of the design wavelength of the antenna assembly.

11. A slot antenna as defined in claim 10 further comprising a dielectric material adjacent the open end of the slot.

12. A slot antenna assembly comprising:

a circuit board;

an antenna layer on the circuit board, the antenna layer having an edge, the antenna layer defining a zigzag slot including a plurality of linear slot segments, the zigzag slot opening through the edge of the antenna layer and including an open end adjacent the edge and an opposite closed end, the closed end defining a T shape, the zigzag slot defining a length one-quarter of the design wavelength of the antenna assembly;

a feed connected across the zigzag slot;

a dielectric material adjacent the open end;

a plurality of circuit components supported by the board, at least one of the plurality of circuit components electrically connected to the feed; and wherein the width of at least one of the plurality of linear slot segments is greater toward the open end than toward the closed end.

* * * * *